US005604947A

United States Patent [19]

Bates et al.

[11] Patent Number: 5,604,947

[45] Date of Patent: Feb. 25, 1997

[54] PLIER-TYPE TOOL FOR GRIPPING, TWISTING, AND PULLING WIRES

[75] Inventors: Darryle E. Bates, Stowe, Ohio; Vincent J. Kiernan, Marco Island, Fla.

[73] Assignee: Milbar Corporation, Chagrin Falls, Ohio

[21] Appl. No.: 371,275

[22] Filed: Jan. 11, 1995

[51] Int. Cl.[6] ..... B25B 7/22

[52] U.S. Cl. ..... 7/133; 81/426; 140/121

[58] Field of Search ..... 7/133, 117; 81/426; 104/117, 118, 121

[56] References Cited

U.S. PATENT DOCUMENTS 3,694,834 10/1972 Daniels, Jr. .

4,665,953 5/1987 Randall .

*Primary Examiner*—James G. Smith

*Attorney, Agent, or Firm*—Calfee, Halter & Griswold

[57] ABSTRACT

A pair of pliers for gripping, twisting, and cutting wires having undulating wire gripping surfaces, a wire cutting cavity, and a resilient wire gripping material. The undulating wire gripping surfaces have high and low portions that unequally traverse the gripping surfaces and extend unequally beyond the centerline of the pliers. Such a configuration provides an equally distributed gripping force for an entire range of wires without causing any nicks and scrapes on the wire. The cutting cavity has a plurality of surfaces that form tiger tooth-like members. The geometry formed by the cavity's surfaces and tooth-like members provides a large surface area for the resilient gripping material to adhere to.

15 Claims, 3 Drawing Sheets

PLIER-TYPE TOOL FOR GRIPPING, TWISTING, AND PULLING WIRES

FIELD OF THE INVENTION

The present invention relates generally to plier-type hand tools and, more specifically, to a pair of pliers suitable for gripping wires or sheet stock without marring or permanently deforming the material being gripped.

BACKGROUND OF THE INVENTION

The use of pliers to grip, twist, and cut wires has long assisted workers and tradesmen in performing their duties quickly and effectively. Originally, pliers were in the form of single purpose tools which could perform only a single function e.g., gripping exclusively. Thus, a tradesman was required to have a different pair of pliers for each task.

As the nature of equipment and tools became more sophisticated, the use of single function pliers became disadvantageous due the large variety and types of pliers required to perform a particular task. Eventually, multi-functional pliers were developed that would perform the same functions as would several single function pliers. In this manner, the tradesman saved money and time by having to purchase only one pair of pliers that could perform several functions.

A common, but critical, practice that requires the use of multi-functional pliers is the locking of screws or bolts on machinery that is subject to considerable vibrations, such as on engines for aircraft and the like. By providing a hole through a head of a bolt, a wire may be inserted through the hole and then secured or anchored to another object to prevent the bolt from unfastening when subjected to high levels of vibration.

In particular, one end of a high tensile steel wire would be passed through the hole in the head of a bolt and drawn through to a particular length. The wire would then be drawn for a length greater than the distance between the next adjacent bolt desired to be wire locked or an anchoring object. The wire is then pulled tight and twisted in order to maintain the wire taut. In a similar fashion, one of the ends of the wire would then be passed through the hole of the adjacent bolt or anchoring object and then drawn tight and twisted up to a distance approximately equal to the next adjacent bolt or anchor object. After the final bolt or anchoring object is locked, the wire must be tied at the ends and any excess wire remaining must be cut. The wire is then bent over so that it is out of the way. A wire is typically long enough to allow locking of two or three bolts, but other lengths are possible and one may also wire lock a single bolt.

Plier designers have had limited success in designing a pair of pliers that perform the gripping, twisting, and cutting functions that are essential to wire locking without nicking or scraping the wire. Flat, smooth jaw surfaces did not impart sufficient friction to keep wires from pulling out of the jaws. Hence, some designers have provided pliers with serrated wire gripping surfaces which provide a secure grip of the wire during the gripping and twisting phases of the wire locking process. However, the serrated gripping surfaces function primarily by cutting into the wire, thereby creating portions of wire which contained nicks and scrapes. These nicks and scrapes made the wire increasingly susceptible to failure at those portions, thereby limiting the amount of tension that the wires may withstand.

To solve these problems, designers developed pliers that incorporated wavy or undulating gripping surfaces that were not serrated. These undulations provided a slope that increased the frictional resistance on the wire and the lack of serrations or sharp corners eliminated nicking and scraping of the wire. However, the previous designs suffered from several disadvantages: 1) the large amplitudes necessary to increase the frictional resistance are too great to allow formed wire to pass through standard pre-drilled holes, and 2) the sine wave pattern exhibiting equivalent radii does not permit the jaw gripping force to be fully distributed along the wire. Resultingly, these designs served to pinch or flatten the wire at the slope transition which caused an unacceptable deformation.

Also, since wire locking is often performed in sensitive environments, such as engine bays, the tradesman had to ensure that the excess wire cut off did not fall into the engine. When the wires were cut, the force applied by the pliers tended to produce a force perpendicular to the cut, which in effect, "shot" the loose end of the wire away from the pliers. A piece of wire unaccounted for in such a sensitive environment could have disastrous effects and thus must be located at all costs.

To solve this problem, plier designers provided a resilient material between the plier's jaws to hold the loose end during cutting thereby preventing it from falling into unwanted areas. However, through normal usage the resilient material eventually detached itself from the pliers. The pliers then had to be discarded and replaced with a new pair.

SUMMARY OF THE INVENTION

According to the present invention, a plier-like tool is provided for gripping, twisting, and cutting wires or sheet stock without substantially marring the material. The pliers employ a pair of plier arms equidistant from a centerline through a pivot joint and jaws that comprise undulating gripping surfaces having high and low portions that traverse each gripping surface and extend unequally spaced on each side of the centerline, allowing the pliers to apply a more evenly distributed load over the length of the jaws. The high and low portions may be formed of selected radii and center points or may be approximated by a prolate trochoid function so as to evenly distribute loadings to the wire without pinching or flattening, as well as accommodating the various wire diameters in the wire locking industry.

The pliers of the present invention also include edges for cutting wires and an plurality of cavity-forming inner surfaces into which a resilient wire gripping material that grips and maintains loose wire segments within the plier jaws after cutting is situated. The cavity employs tooth-like members, formed by the plurality of surfaces integral to the internal cavity. These surfaces provide additional adhesion surfaces for retaining the resilient wire gripping material.

Further, the pliers may be adapted to include a combination wire twisting and jaw locking mechanism. The jaw locking mechanism serves to lock the jaws closed, thereby maintaining a jaw gripping force, and to automatically release the jaws from the closed position.

It is therefore an advantage of the present invention to provide a multi-functional pair of pliers for gripping, twisting and cutting wires without marring the wires.

It is a further advantage of this invention to provide a multi-functional pair of pliers which have an enhanced cutting cavity adapted to receive a resilient gripping material and to prevent detachment thereof, and thus extend the useful life of the pliers.

It is further another advantage of this invention to provide a multi-functional pair of pliers that allow a gripping force to be equally distributed along the entire gripping surfaces for a complete range of wires used in wire locking.

These and other advantages of the present invention will become more apparent from a detailed description of the invention.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to example the principles of this invention.

DETAILED DESCRIPTION OF THE ILLUSTRATED EMBODIMENT

Figure 1:
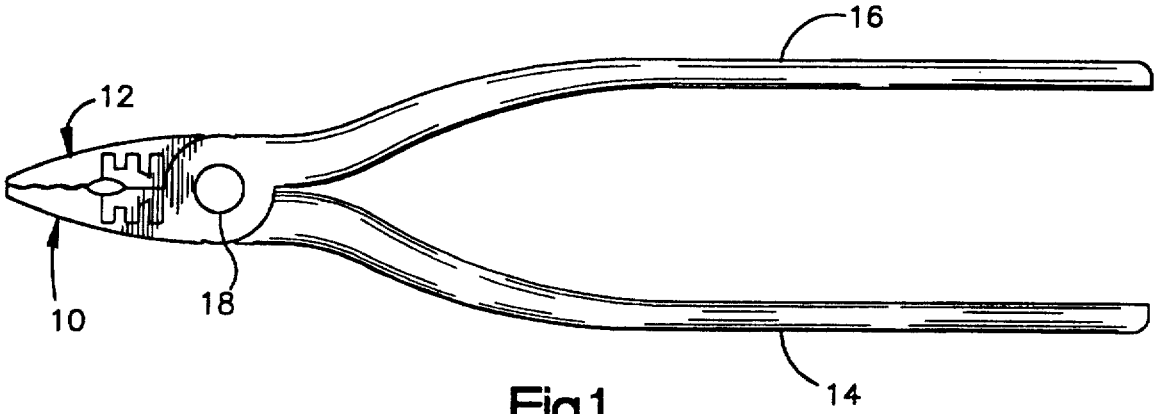
FIG. 1 is a side elevational view of the pliers of the present invention.

A typical embodiment of the pliers of the present invention is illustrated in FIG. 1, which is a side elevational view. The pliers have a pair of jaws 10 and 12, a pair of handles or plier arms 14 and 16, and a pivot joint 18. The pliers are constructed in the very well known manner of machining the jaws 10 and 12, plier arms 14 and 16 and pivot joint 18 all integral to two members of steel.

Figure 2:
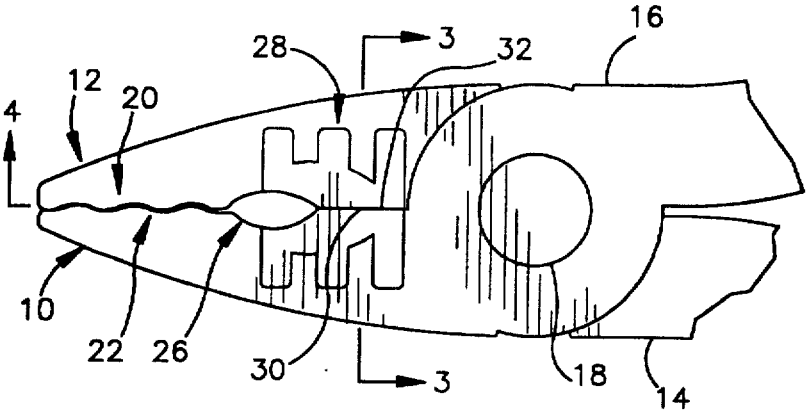
FIG. 2 is a side elevational view of the jaws of the pliers of the present invention with the handles broken away.

FIG. 2 shows a side elevational view of the jaws 10 and 12 of the pliers and the pivot joint 18 with the plier arms 14 and 16 broken away. The jaws 10 and 12 have two undulating gripping surfaces 20 and 22, a wire pass through aperture 26, and a wire cutting cavity 28 with wire cutting edges 30 and 32.

Figure 3:
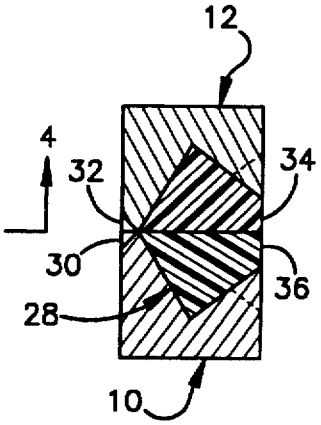
FIG. 3 is a sectional view of the pliers through line 3—3 of FIG. 2.

FIG. 3 shows a sectional view of the pliers through line 3—3 of FIG. 2. The wire cutting cavity 28 is shown with a resilient gripping means having an upper portion 34 and a lower portion 36 pervading the cavity 28. The upper and lower portions 34 and 36 are preferably of a resilient material capable of tightly holding portions of wire while the cutting edges 30 and 32 cut the wire. The resilient gripping material (portions 34 and 36) is preferably formed by using the wire cutting cavity as a mold and thereby pouring the resilient material, while in its liquid state, into the mold.

Figure 4:
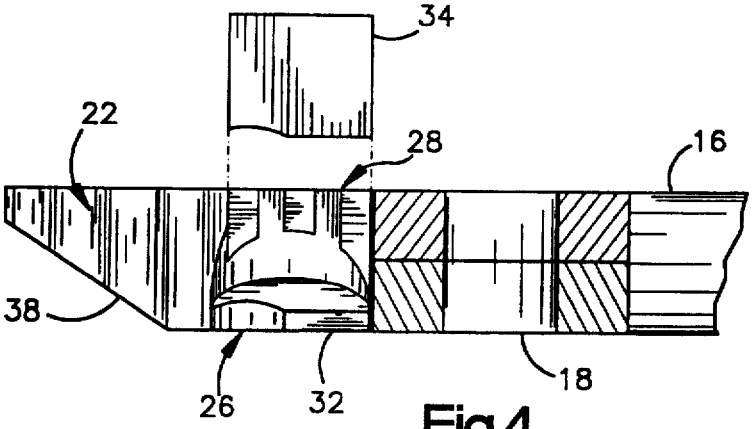
FIG. 4 is a plan view taken from line 4—4 of FIG. 2 illustrating the cutting cavity, and other features of the pliers of the present invention.

FIG. 4 is a plan view taken from line 4—4 of FIG. 2 illustrating the cutting cavity 28 and other features of the pliers of the present invention. A surface 38 traverses both the jaw 10 and 12 so as to make the jaws wide near the pivot joint 18 and progressively narrower at points further therefrom. This allows the tips of the jaws 10 and 12 to be easily maneuverable in narrow and tight spaces. The surface 38 is preferably in the form of a partial conical type surface and split into a portion on jaw 10 and a portion on jaw 12.

Figure 5:
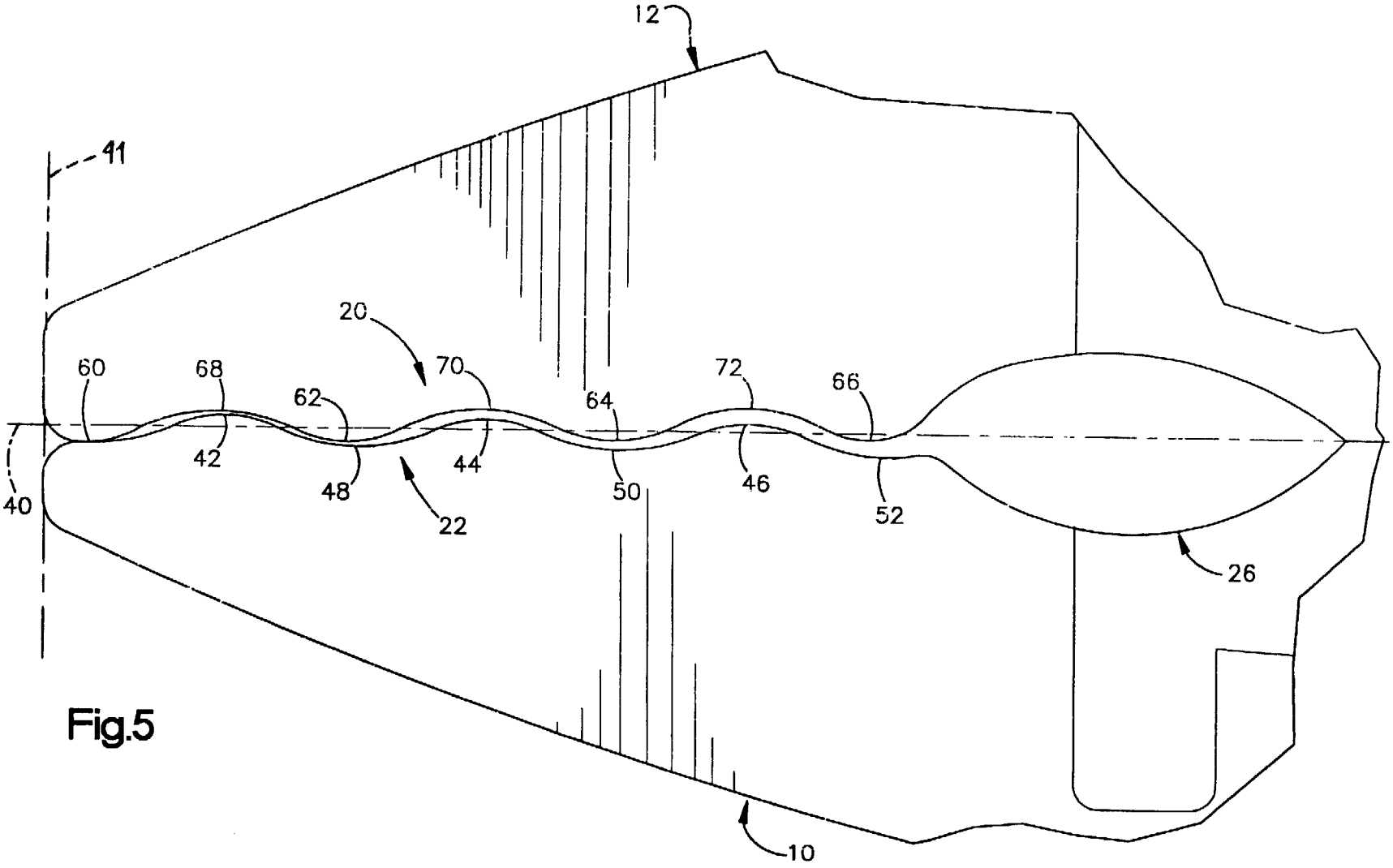
FIG. 5 is a side elevational view of the jaws of the pliers of the present invention illustrating the wire gripping surfaces in detail.

Referring now to FIG. 5, a side elevation view of the jaws 10 and 12 is shown in detail along with a centerline 40 that runs through the center of the pliers. Wire gripping surfaces 20 and 22 are each in the form of an undulating gripping surface. The surfaces 20 and 22 comprise a plurality of high and low portions traversing each surface and extending unequally spaced on each side of the centerline 40.

On jaw 10, the high portions 42–46 transverse the wire gripping surface 22 at unequal spacings and extend unequally spaced from the centerline 40. The high portions are formed such that portion 46 extends less than portion 42 beyond the centerline 40 as defined by an angle of 0 degrees 30 minutes from the centerline 40 to a peak line formed by the peaks of high portions 42–46 (peak line not shown). The low portions 48–52 traverse the wire surface at unequal spacings and are withdrawn unequally spaced from the centerline 40.

On jaw 12, the high portions 60–66 traverse the wire gripping surface 20 at unequal spacings and extend unequally from the centerline 40. The high portions are formed such that portion 66 extends less than portion 60 beyond the centerline 40 as defined by an angle of 0 degrees 30 minutes from the centerline 40 to a peak line formed by the peaks of high portions 60–66 (peak line not shown). The low portions 68–72 traverse the wire surface at unequal spacings and are withdrawn unequally spaced from the centerline 40.

The high and low portions (42–72) that comprise the wire gripping surfaces 20 and 22 are preferably in the form of a plurality of selected radii and center points. The radii and center points are selected such that the wave height (predetermined to be a maximum of 0.20 inches), or amplitude formed thereby on all wire diameters (comprising the range of wire diameters from 0.20 to 0.051 inches), is small enough to permit a deformed wire to easily pass through a standard pre-drilled bolt hole. Additionally, the peak radii of portions 60, 62, 64, 66, and 42, 44, and 46 are large enough to avoid indenting a wire at standard tool jaw pressures. At standard tool jaw pressures, these radii are determined to be a minimum of 0.090 inches (See Tables I–IV for illustrative values).

On jaw 12, the low portions 68–72 have a radius larger than the high portions 60–66 so as to create an enlarged gap at a maximum slope of the wire surface 20 profile which avoids pinching or flattening of the wire at those locations. Jaw 10 is similarly constructed with low portions 48–52 having a radius larger than the high portions 42–46. Additionally, low portions 68–72 on jaw 12 have larger radii than their opposing high portions 42–46 on jaw 10. Similarly, low portions 48–52 have larger radii than high portions 62–66. Blending of these high and low radii creates the pitch, distance between peaks. This distance is minimized to create as many high and low portions as allowed in a preset jaw length.

The high and low portion configuration may also be approximated by an angled prolate trochoid function (angle as defined above). The prolate trochoid function may be defined by the following:

Parameters:

h=0.020 (maximum wave height)

p=0.182 (minimum pitch)

p=0, 0.05, . . . 30 (theta displacement angle (minutes))

$$r = \frac{p}{2\pi} \quad \text{(rolling radius)}$$

$$b = \frac{h}{p} \quad \text{(point on rolling circle < r)}$$

Prolate trochoid function:

x(t)=(rxt-bxsin(t))

y(t)=(r-bxcos(t))

The above prolate trochoid function comprises continuously changing radii and may serve in the same capacity as two unequal radii blended together at their tangencies. This prolate trochoid function, although successful, requires slight experimental modification in order for the optimized high and low point surface configuration (as described above) to be achieved.

Also, as mentioned above, selected radii and center points may be used to define the gripping surfaces 20 and 22. One set of suitable values (in inches) is listed in Tables I–IV. In Tables I–IV, the Nose of the Jaws is defined by reference line 41 in FIG. 5. Furthermore, the above defined prolate trochoid function can, with slight experimentation, be modified to define the values listed in Tables I–IV.

TABLE I

| Gripping Surface 22; High Portion | Center point distance from Nose of jaws: | Peak Radius |
|---|---|---|
| 42 | .121 | .095 |
| 44 | .301 | .095 |
| 46 | .481 | .095 |

TABLE II

| Gripping Surface 22; Low Portion | Center point distance from Nose of jaws: | Radius |
|---|---|---|
| 48 | .209 | .122 |
| 50 | .389 | .122 |
| 52 | .573 | .122 |

TABLE III

| Gripping Surface 22; High Portion | Center point distance from Nose of jaws: | Peak Radius |
|---|---|---|
| 60 | .031 | .095 |
| 62 | .209 | .095 |
| 64 | .389 | .095 |
| 66 | .556 | .095 |

TABLE IV

| Gripping Surface 22; Low Portion | Center point distance from Nose of jaws: | Radius |
|---|---|---|
| 68 | .121 | .122 |
| 70 | .301 | .122 |
| 72 | .481 | .122 |

The aforementioned high and low portion configuration of jaws 10 and 12 allows the pliers of the present invention to distribute a gripping force around opposably engageable high and low portions on each jaw so as to minimize the pinching effect on a wire. By having such a configuration, the pliers of the present invention may grip an entire range of wires with an evenly distributed force. By being able to assert an evenly distributed force, wire deformation and damage caused thereby is minimized.

Additionally, the high and low portions provide a sloped surface area for gripping wires which is essential when the pliers are used to pull a wire. In particular, a grip force is maximized by transmitting a wire pull force into a frictional resistive force. The percentage of grip force transmitted is a function of the slope between the high and low portions of each law.

Figure 6:
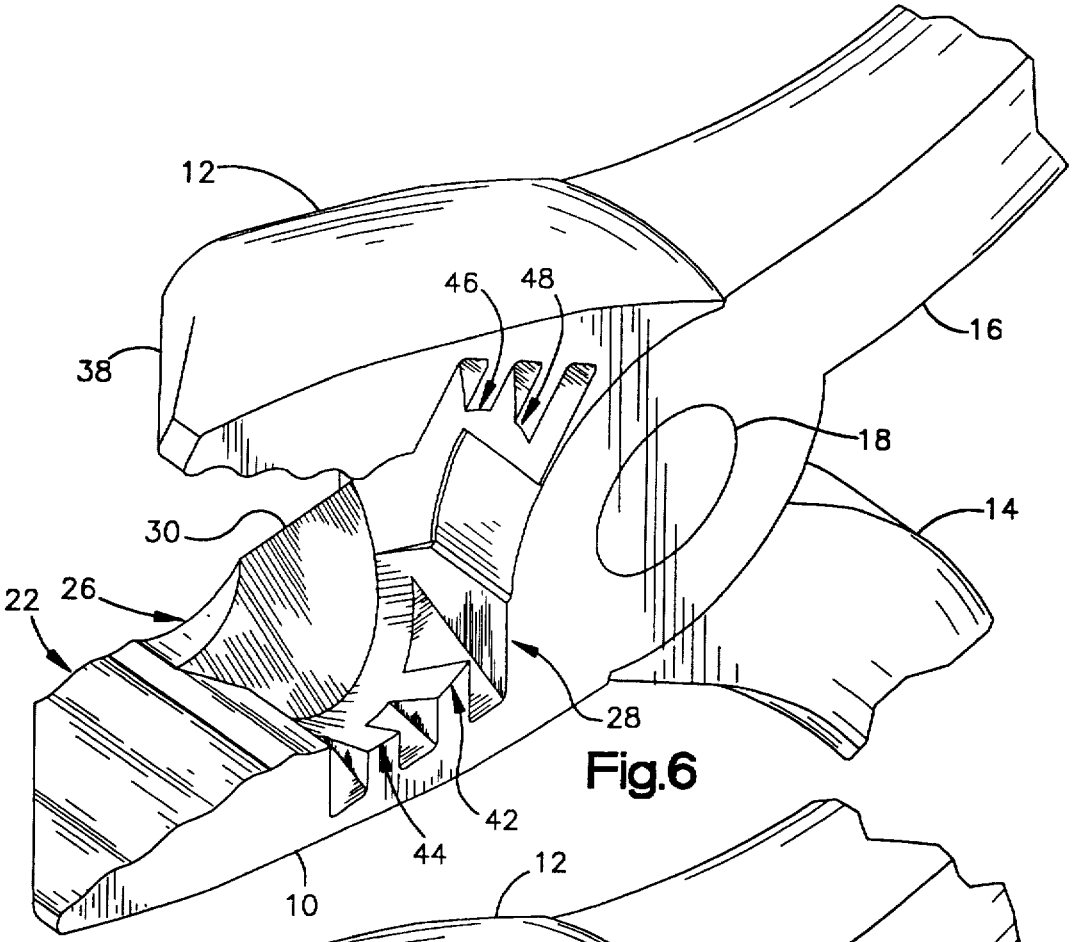
FIG. 6 is a perspective view of the pliers of the present invention detailing the cutting cavity.

Referring now to FIG. 6, which shows a perspective view of the pliers of the present invention revealing the wire cutting cavity 28. The wire cutting cavity 28 comprises a plurality of surfaces and tooth-like members 82–88 formed thereby. In particular, the cutting cavity 28 includes an ungula of a right circular cylinder, the bottom of which provides a surface from which wire cutting edges 30 and 32 (32 not shown in FIG. 6) are formed.

The cylindrical ungula and tooth-like members 82–88 provide the wire cutting cavity 28 with a large surface area onto which a resilient wire gripping material may adhere to. The surfaces formed by the tooth-like members 82–88 are orthogonal and opposite to each other thereby allowing a resilient gripping material to resist the strain caused by wire cutting that, through time, tend to cause the resilient wire gripping material to detach itself from the pliers. Such a design improves wear and tear capability, thus extending the life of the tool.

Figure 7:
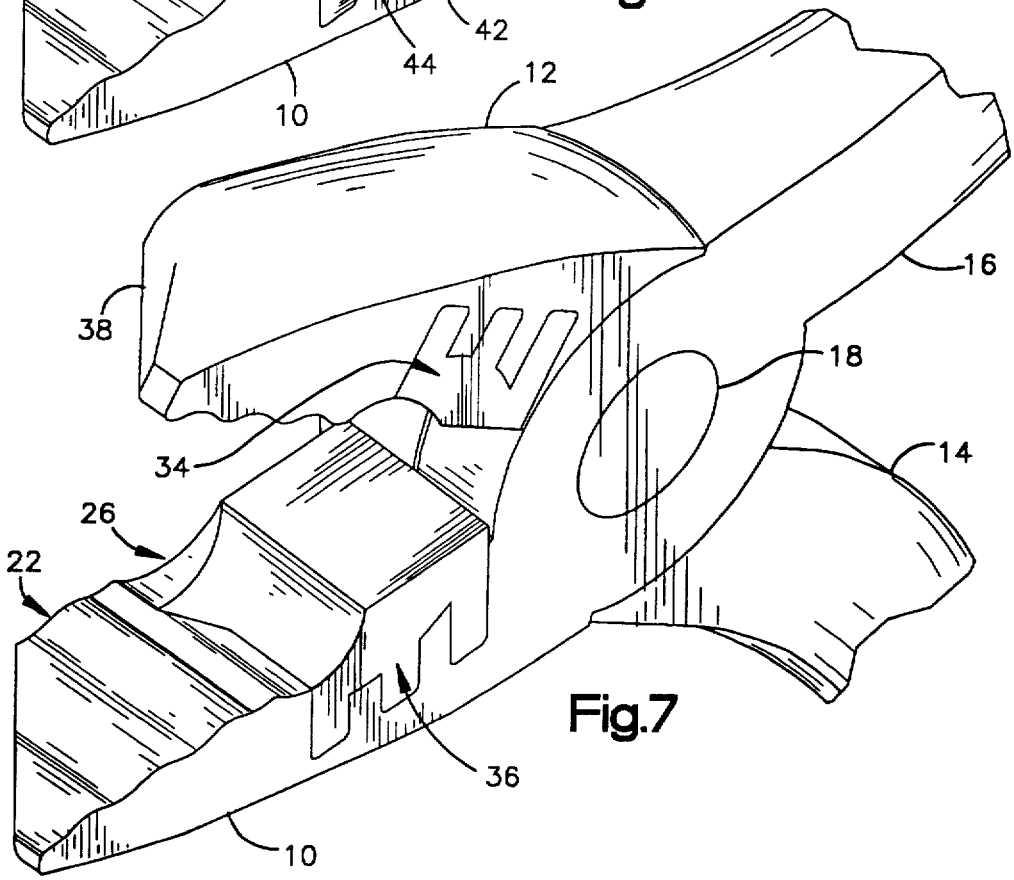
FIG. 7 is a perspective view of the pliers of the present invention shown with a resilient gripping material molded into the cutting cavity.

Referring now to FIG. 7, which shows a perspective view of the pliers of the present invention with a resilient gripping material 34 and 36 molded into the cutting cavity 28. The resilient gripping material 34 and 36 are opposably engageable and cause a wire placed in the cavity to be secured tightly during cutting. By having the wire secured tightly during cutting, the risk of a piece of the cut wire falling into unwanted places is minimized.

The pliers may also include a combination wire twisting and jaw locking mechanism. The jaw locking mechanism serves to lock the jaws closed, thereby maintaining a jaw gripping force, and to automatically release the jaws from the closed position. Such a mechanism is well known in the art and incorporation into the present invention would be obvious to one having ordinary skill in the art. One such combination wire twisting and jaw locking mechanism is described in U.S. Pat. No. 4,665,953 by Randall (the text and drawings of U.S. Pat. No. 4,665,953, as fully set forth, is hereby incorporated by reference.) Other similar combination wire twisting and jaw locking mechanisms may also be incorporated into the present invention.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the wire surfaces may comprise additional high and low portions, the high and low portion spacings may be varied, and the cutting cavity may have additional tooth-like members or surfaces. Therefore, the invention in its broader aspects is not limited to the specific details, the representative apparatus, and illustrative examples shown and described. Accordingly, departures may be made from such details without departing from the spirit or scope of the applicant's general inventive concept.

I claim:

1. A plier-type tool for gripping wires, comprising a centerline and a pair of plier arms equidistant from said centerline, each plier arm having:

(a) a jaw portion, wherein said jaw portion comprises undulating wire gripping surfaces, wherein each of said undulating wire gripping surface comprises a plurality of high and low portions, each of said high and low portions having a given radius, b. a handle portion, c. a pivot joint interconnecting said arms for allowing movement of said jaw portion from an open to a closed position; and wherein said jaw portions are opposably engageable with each other such that the high portions of the wire gripping surface on one jaw are opposably engageable with the low portions of the wire gripping surface on the opposing jaw, and wherein each of the given radii of said high and low portions is selected such that the given radii of said high portions are less than the given radii of said opposably engageable low portions.

2. The tool of claim 1, wherein each jaw portion further comprises a plurality of cavity-forming inner surfaces; said cavity-forming inner surfaces comprising a cutting edge.

3. The tool of claim 2, wherein said plurality of cavity-forming inner surfaces comprises an ungula of a right circular cylinder.

4. The tool of claim 2, wherein said plurality of cavity-forming inner surfaces further comprise surfaces that form tooth-like members.

5. The tool of claim 2, wherein said plurality of cavity-forming surfaces comprise a cavity containing a resilient material for gripping wires.

6. The tool of claim 1, wherein said high and low portions of each wire gripping surface are unequally spaced from each side of said centerline.

7. The tool of claim 1, wherein said high and low portions of each wire gripping surface are unequally spaced.

8. The tool of claim 1, wherein said undulating wire gripping surfaces comprise an approximated prolate trochoid function.

9. The tool of claim 1, wherein said undulating wire gripping surfaces comprise an approximated prolate trochoid function angled with respect to said centerline.

10. The tool of claim 1, further comprising a combination wire twisting and jaw locking mechanism.

11. A plier-type tool for gripping, cutting, and twisting wires, having a pair of jaws, a pair of handles integral to said jaws and pivotally engageable with each other to form a pivot joint, wherein said jaws comprise:

(a) an upper and a lower jaw;

(b) a pair of undulating gripping surfaces integral to said upper and lower jaws and opposably engageable with each other wherein each of said surfaces comprises a plurality of opposably engageable high and low portions, each of said high portions and said low portions having a given radius selected such that the given radius of each high portion is less than the given radius of the opposably engageable low portion; and (c) a cavity for containing a resilient material for holding a wire during cutting, wherein said cavity comprises:

(1) a plurality of inner surfaces wherein at least two of said inner surfaces form cutting edges, and (2) a plurality of tooth-like members integral to said plurality of inner surfaces, wherein at least one of said plurality of tooth-like members is comprised of at least one curved inner surface.

12. The tool of claim 11 wherein each undulating gripping surface is in the form of an approximated prolate trochoid function.

13. The tool of claim 11 wherein each undulating gripping surface is in the form an approximated prolate trochoid function angled with respect to said centerline.

14. The tool of claim 11, further comprising a combination wire twisting and jaw locking mechanism.

15. A plier-type tool for gripping, cutting, and twisting wires, having a pair of jaws, a pair of handles integral to said jaws and pivotally engageable with each other to form a pivot joint, wherein said jaws comprise:

(a) an upper and a lower jaw; and (b) a cavity for containing a resilient material for holding a wire during cutting, wherein said cavity comprises:

(1) a plurality of inner surfaces wherein at least two of said inner surfaces form cutting edges, and wherein said plurality of cavity-forming surfaces of said upper jaw and said lower jaw each comprise an ungula of a right circular cylinder and (2) a plurality of tooth-like members integral to said plurality of inner surfaces, wherein at least one of said plurality of tooth-like members is comprised of at least one curved inner surface.

* * * * *